US010364637B2

(12) United States Patent
Walton et al.

(10) Patent No.: US 10,364,637 B2
(45) Date of Patent: Jul. 30, 2019

(54) DOWNHOLE SUB WITH COLLAPSIBLE BAFFLE AND METHODS FOR USE

(71) Applicant: Halliburton Energy Services, Inc., Houston, TX (US)

(72) Inventors: Zach William Walton, Carrollton, TX (US); Matthew James Merron, Carrollton, TX (US); John Todd Broome, Highlands Ranch, CO (US); Matt Todd Howell, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 244 days.

(21) Appl. No.: 15/327,869

(22) PCT Filed: Aug. 22, 2014

(86) PCT No.: PCT/US2014/052314

§ 371 (c)(1),
(2) Date: Jan. 20, 2017

(87) PCT Pub. No.: WO2016/028315

PCT Pub. Date: Feb. 25, 2016

(65) Prior Publication Data

US 2017/0204698 A1 Jul. 20, 2017

(51) Int. Cl.
*E21B 33/12* (2006.01)
*E21B 34/14* (2006.01)
(Continued)

(52) U.S. Cl.
CPC ..... *E21B 33/1208* (2013.01); *E21B 23/01* (2013.01); *E21B 34/14* (2013.01); *E21B 43/25* (2013.01); *E21B 43/26* (2013.01)

(58) Field of Classification Search
CPC ..... E21B 33/12; E21B 34/14
See application file for complete search history.

(56) References Cited

U.S. PATENT DOCUMENTS 7,322,417 B2 * 1/2008 Rytlewski ..... E21B 23/02 166/313
2007/0272413 A1 * 11/2007 Rytlewski ..... E21B 34/14 166/318

(Continued)

FOREIGN PATENT DOCUMENTS

WO 02/068793 A1 9/2002
WO 2012037661 A1 3/2012
WO 2013/009458 A2 1/2013

OTHER PUBLICATIONS

International Search Report and Written Opinion issued in related PCT Application No. PCT/US2014/052314 dated May 15, 2015, 15 pages.

(Continued)

*Primary Examiner* — Catherine Loikith
(74) *Attorney, Agent, or Firm* — John W. Wustenberg; Baker Botts L.L.P.

(57) ABSTRACT

A collapsible baffle sub installable within a casing string of a hydrocarbon well. The collapsible baffle sub includes a movable sleeve and a collapsible baffle. By moving the sleeve from a first to a second position using a setting tool, the collapsible baffle is permitted to collapse within the collapsible baffle sub. Once collapsed, the collapsible baffle may receive an untethered object, such as a ball, forming a seal between the untethered object and the collapsible baffle and isolating sections of the wellbore for treatment.

16 Claims, 3 Drawing Sheets

(51) Int. Cl.

| | |
|---|---|
| ***E21B 23/01*** | (2006.01) |
| ***E21B 43/25*** | (2006.01) |
| ***E21B 43/26*** | (2006.01) |

(56) References Cited

U.S. PATENT DOCUMENTS

| | | | | |
|---|---|---|---|---|
| 2010/0258293 | A1 | 10/2010 | Lynde et al. | |
| 2011/0278017 | A1 | 11/2011 | Themig et al. | |
| 2013/0153220 | A1 | 6/2013 | Carter et al. | |
| 2013/0319669 | A1 | 12/2013 | Dupree et al. | |
| 2014/0166112 | A1 | 6/2014 | Cast et al. | |
| 2014/0318815 | A1* | 10/2014 | Merron | E21B 34/14 166/386 |
| 2014/0318816 | A1* | 10/2014 | Hofman | E21B 34/14 166/386 |
| 2017/0350214 | A1* | 12/2017 | Norman | E21B 34/14 |

OTHER PUBLICATIONS

International Preliminary Report on Patentability issued in related Application No. PCT/US2014/052314, dated Mar. 9, 2017 (12 pages).

Office Action issued in Great Britain application No. GB1622145.9, dated Nov. 21, 2018 (3 pages).

Examiner's letter issued in Canadian application No. 2,955,579, dated Nov. 7, 2017 (3 pages).

* cited by examiner

DOWNHOLE SUB WITH COLLAPSIBLE BAFFLE AND METHODS FOR USE

CROSS-REFERENCE TO RELATED APPLICATION

The present application is a U.S. National Stage Application of International Application No. PCT/US2014/052314 filed Aug. 22, 2014, which is incorporated herein by reference in its entirety for all purposes.

BACKGROUND

Hydrocarbon-producing wells commonly consist of a wellbore extending through a subterranean formation and lined with a tubular casing. Cement is pumped into an annulus between the wellbore and the casing to fix the casing within the wellbore. Once the casing is cemented in place, a perforating gun is lowered to depth within the casing and fired to create one or more perforations extending through the casing and cement and into the surrounding formation. The perforations generally permit communication of fluid between the internal volume of the casing and the surrounding formation.

Once perforated, wells are often stimulated using various stimulation treatments to improve production. In hydraulic fracturing treatments, for example, a viscous fracturing fluid is pumped into a perforated production zone at sufficiently high pressure to create fractures within the production zone and to propagate existing or newly created fractures. The fractures improve production by providing new or enhancing existing pathways for fluid to move between the formation into the casing.

An acidizing is another example of a treatment that may be performed on a wellbore. Acidizing treatments involve the introduction of an acid or similar fluid into the formation. The acid dissolves debris introduced into the formation during perforation and fracturing. Acidizing may also be used to improve permeability of the formation by partially dissolving the formation, enlarging existing fluid pathways.

A well may include multiple production zones, with each production zone requiring its own perforation and treatment. Production zones are typically perforated and treated beginning with the farthest downhole production zone and proceeding sequentially uphole. To properly treat an uphole production zone, an operator may need to isolate the uphole production zone from downhole production zones that have been previously perforated and treated. For example, in fracturing treatments, isolating an uphole production zone to be fractured from a downhole production zone that has already been fractured enables more efficient build-up of pressure within the production zone to be fractured because fracturing fluid is not lost to the formation via the previously fractured production zone. Isolation in the fracturing context may also protect the previously fractured production zone from additional, unwanted fracturing.

Given the prevalence of stimulation treatments, there is a consistent drive among operators to lower costs and improve efficiencies associated with completion and fracturing operations.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to stimulation treatment operations and specifically to a collapsible baffle sub for isolating production zones to be treated.

Illustrative embodiments of the present invention are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time consuming, but would nevertheless be a routine undertaking for those of ordinary skill in the art having the benefit of the present disclosure.

To facilitate a better understanding of this disclosure, the following examples of certain embodiments are given. In no way should the following examples be read to limit, or define, the scope of the claims.

Figure 1A:
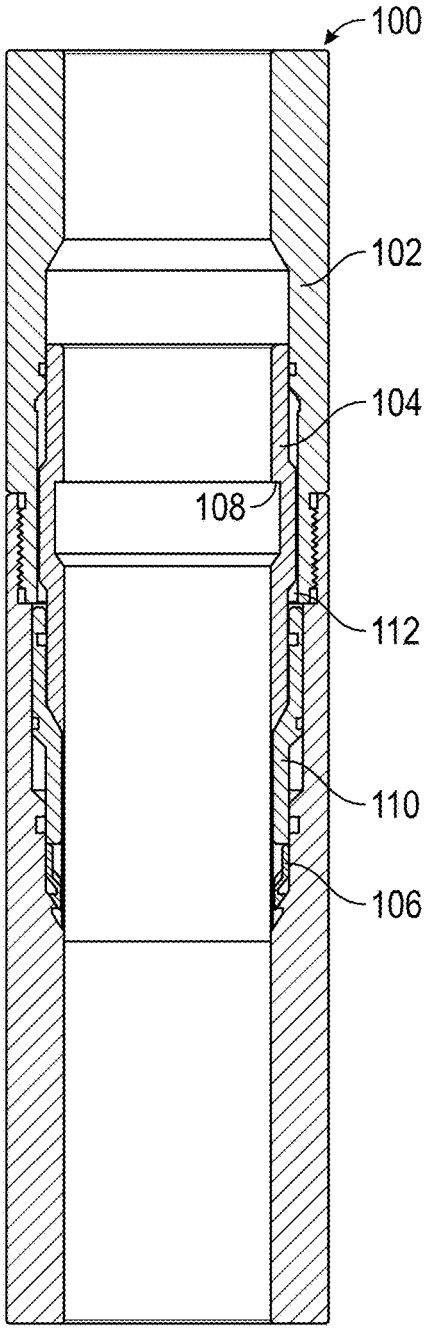
FIGS. 1A and 1B are cross-sectional views of a collapsible baffle sub according to one embodiment.

FIG. 1A depicts a collapsible baffle sub 100 for facilitating treatment of production zones of a wellbore. The collapsible baffle sub 100 is inserted into the wellbore as a section of a casing string and includes an outer housing 102, a sleeve 104, and a collapsible baffle 106. A given length of casing string may include one or more collapsible baffle subs for facilitating treatment of multiple production zones within a single wellbore.

The outer housing 102 houses components of the collapsible baffle sub 100 and connects the collapsible baffle sub 100 to adjacent sections of the casing string. Depending on the configuration of the casing string, the outer housing 102 may be configured to connect to adjacent casing string sections using various threaded connections. For example, in a typical casing string, pipe joints having male-threads on both ends and are connected to each other by couplings having female-threaded ends. In such casing strings, the outer housing 102 may include two female-threaded connections for installation between two pipe joints, two male-threaded connections for installation between two couplings, or one each of a male-threaded connection and a female-threaded connection for installation between a pipe joint and a coupling.

The specific lengths and arrangement along the casing of pipe joints, couplings, collapsible baffle subs, and other casing string sections will vary based on the wellbore in which the casing string is to be installed. For example, wellbore depth and directionality and the location of production zones within the subterranean formation through which the wellbore extends will dictate the length of particular sections of pipe joints and the location of the collapsible baffle subs. To facilitate treatment of a particular production zones, the collapsible baffle subs are positioned along the casing string such that when the casing string is installed within the wellbore, a collapsible baffle sub for isolating the particular production zone is positioned downhole of the particular production zone. Accordingly, the position of any collapsible baffle sub along the casing string may be determined by a combination of wellbore geometry and geological information about the subterranean formation through which the wellbore extends.

Figure 1B:
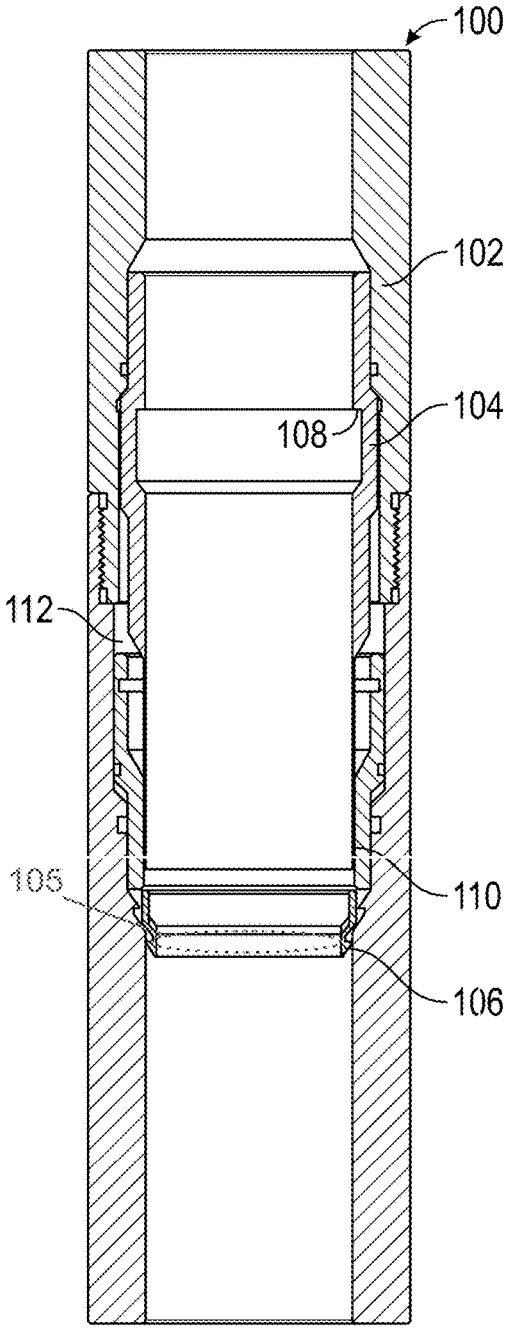

Once a casing string including the collapsible baffle sub 100 is installed in a wellbore, the collapsible baffle sub 100 may be actuated using a shifting tool. To actuate the collapsible baffle sub 100, the shifting tool moves the sleeve 104 from a first position within the outer housing 102, as depicted in FIG. 1A, into a second, uphole position, as depicted in FIG. 1B. In the first position, the sleeve 104 retains the collapsible baffle 106, preventing the collapsible baffle 106 from collapsing within the outer housing 102. In the second position, the sleeve 104 no longer retains the collapsible baffle 106 and the collapsible baffle is permitted to collapse.

In the collapsed position, the collapsible baffle 106 may receive an untethered object 105, such as a ball, inserted into the wellbore. The untethered object 105 and the collapsible baffle 106 are designed such that when the collapsible baffle 106 receives the untethered object 105, a seal is formed between the collapsible baffle 106 and the untethered object 105. As a result, the collapsible baffle and untethered object 105 act as a blockage within the casing string, preventing fluid flow between casing string uphole of the seal and casing string downhole of the seal.

As depicted in FIG. 1A, in the uncollapsed position, the collapsible baffle 106 is retained by the sleeve 104. When the sleeve 104 is in this position, the sleeve 104 may completely conceal the collapsible baffle 106. Concealing the collapsible baffle 106 with the sleeve 104, reduces exposure of the collapsible baffle 106 to fluids, such as cement, that may be pumped through the casing string before the collapsible baffle 106 is required. These fluids may include cement or similarly abrasive fluids that may erode or otherwise damage the collapsible baffle 106, potentially impairing the ability of the collapsible baffle 106 to seal against an untethered object inserted into the wellbore.

To actuate the collapsible baffle sub 100, the sleeve 104 is moved with a setting tool, permitting collapse of the collapsible baffle 106. The setting tool is conveyed into the wellbore using wireline, e-line, coiled tubing or a similar conveyance system and is configured to engage the sleeve 104. As depicted in FIGS. 1A and 1B, the sleeve 104 may include a receiver, such as a lip 108, to receive a portion of the setting tool and facilitate engagement of the setting tool with the sleeve 104. Once the setting tool engages the sleeve 104, the setting tool may be pulled uphole, moving the sleeve 104 within the housing 102 to the position depicted in FIG. 1B. After movement of the sleeve 104, the setting tool may be disengaged from the sleeve 104 and removed from or repositioned within the wellbore.

In any embodiment, the shifting tool may be run downhole as part of a tool string that also includes a perforating gun. A tool string with both a setting tool and perforating gun allows an operator to actuate a collapsible baffle sub and perforate the casing string in a single run. To do so, after actuation, the setting tool is disengaged from the sleeve 104 and the tool string is repositioned within the wellbore such that the perforating gun is aligned with a section of the casing string to be perforated. After the perforating guns are fired, the tool string, including the perforating gun and the setting tool, may be withdrawn.

The setting tool may engage the sleeve 104 in various ways. For example, the setting tool may include one or more deployable keys configured to extend from the setting tool and engage the sleeve 104. In such an embodiment, engagement of the sleeve 104 would first require conveying the setting tool beyond the collapsible baffle sub. The deployable keys may then be deployed and the setting tool pulled back uphole such that the now-deployed deployable keys catch on and engage the sleeve 104 via the lip 108. In embodiments in which the shifting tool is conveyed by a system including a wire, the deployable keys may be deployed in response to an electronic signal sent to the setting tool via the wire. To disengage the sleeve 104 after movement, the setting tool may be configured to retract the deployable keys in response to a second similar signal. Alternatively, the deployable keys may be designed to shear off to release the setting tool. In such embodiments, the collapsible baffle sub would include an internal shoulder against which the sleeve abuts when the sleeve is moved into the second position. The shoulder prevents additional movement of the sleeve. As a result, by pulling on the setting tool with sufficient force after the sleeve 104 has been shouldered, the deployable keys may be sheared and the setting tool released from engagement with the sleeve 104.

Another example of a mechanism for engaging the sleeve 104 is an inflatable bladder disposed on the setting tool. The inflatable bladder may be inflated within the sleeve 104 to contact an inside surface the sleeve 104, sufficiently gripping the sleeve 104 such that the sleeve 104 may be moved into the second position by pulling the setting tool uphole. Once the sleeve 104 is moved into the second position, the inflatable bladder may be deflated, permitting withdrawal of the setting tool.

Once the sleeve 104 is moved and no longer retains the collapsible baffle 106, the collapsible baffle 106 may collapse within the outer housing 102. In the embodiment depicted in FIGS. 1A and 1B, the collapsible baffle 106 is collapsed by an atmospheric piston 110. In embodiments having an atmospheric piston, moving the sleeve 104 permits fluid to enter an atmospheric chamber 112 located behind the atmospheric piston 110. As fluid enters the atmospheric chamber 112, pressure is exerted on the atmospheric piston 110, forcing the atmospheric piston 110 to move and push the collapsible baffle 106 into its collapsed position within the outer housing 102. In other embodiments, the atmospheric piston 110 may be omitted and the fluid pressure of fluid entering the atmospheric chamber 112 may act directly on the collapsible baffle 106 to collapse the baffle. In still other embodiments, collapsible baffle 106 may be mechanically driven into its collapsed position by, for example, a spring, obviating the need for atmospheric piston 110 or atmospheric chamber 112.

Figure 2:
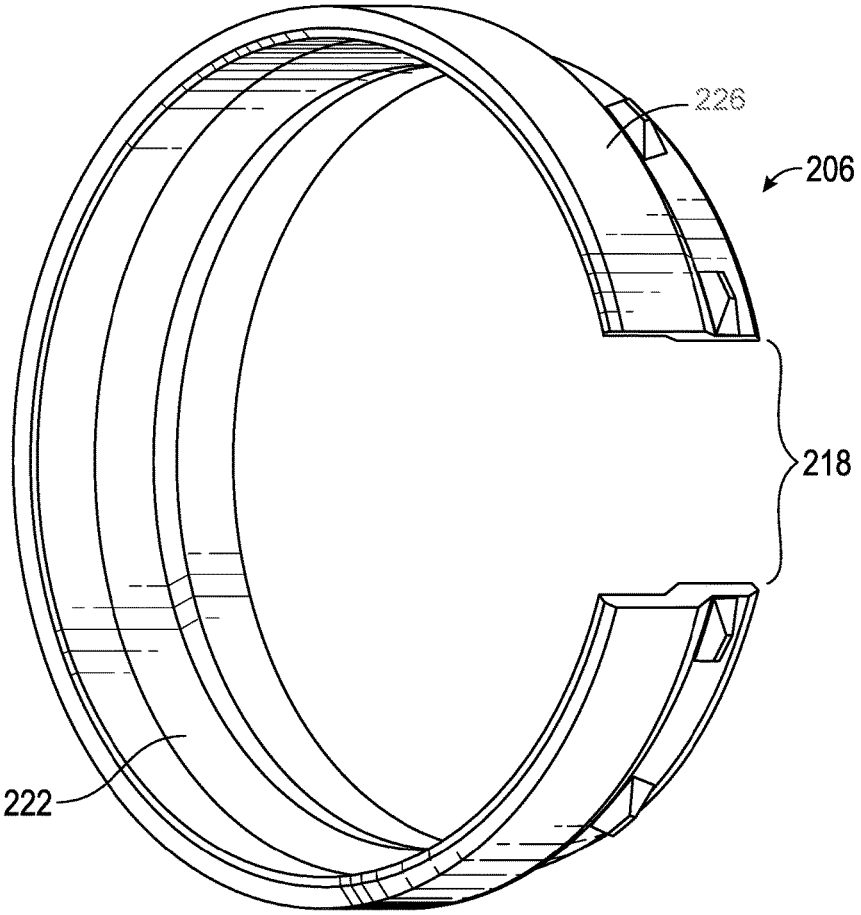
FIG. 2 is an isometric view of a collapsible baffle used within a collapsible baffle sub according to one embodiment.

FIG. 2 depicts one embodiment of a collapsible baffle 206. In the embodiment of FIG. 2, the collapsible baffle 206 is a split-ring. The collapsible baffle 206 includes a split 218 such that when the collapsible baffle is in the uncollapsed position the collapsible baffle 206 has a first diameter. In the collapsed position, the split 218 is closed, causing the collapsible baffle 206 to form a continuous ring having a smaller second diameter. The overall dimensions of the collapsible baffle 206 and the split 218 may vary depending on the change in diameter required between the uncollapsed and collapsed states.

In any embodiment, the collapsible baffle 206 may include a liner or coating applied to some or all of the collapsible baffle 206. For example, a rubber liner may be applied to an inner seating surface 222. As previously discussed, when collapsed, the collapsible baffle 206 may receive and seal against an untethered object, such as a ball. A rubber liner on the inner seating surface 222 may be used to improve sealing between the ball and the collapsible baffle 206. The inner surface 222 may also be coated to improve erosion or chemical resistance.

An outer surface 226 of the collapsible baffle 206 may be similarly coated or lined. A liner or coating on the outer surface 226 may serve various purposes. For example, a coating or lining may be used to improving sealing of the outer surface 226 of the collapsible baffle 206 with an inner surface of the collapsible baffle sub housing. As another example, polytetrafluoroethylene (PTFE) or a similar material may be applied to reduce friction or prevent wear of the collapsible baffle 206.

Figure 3:
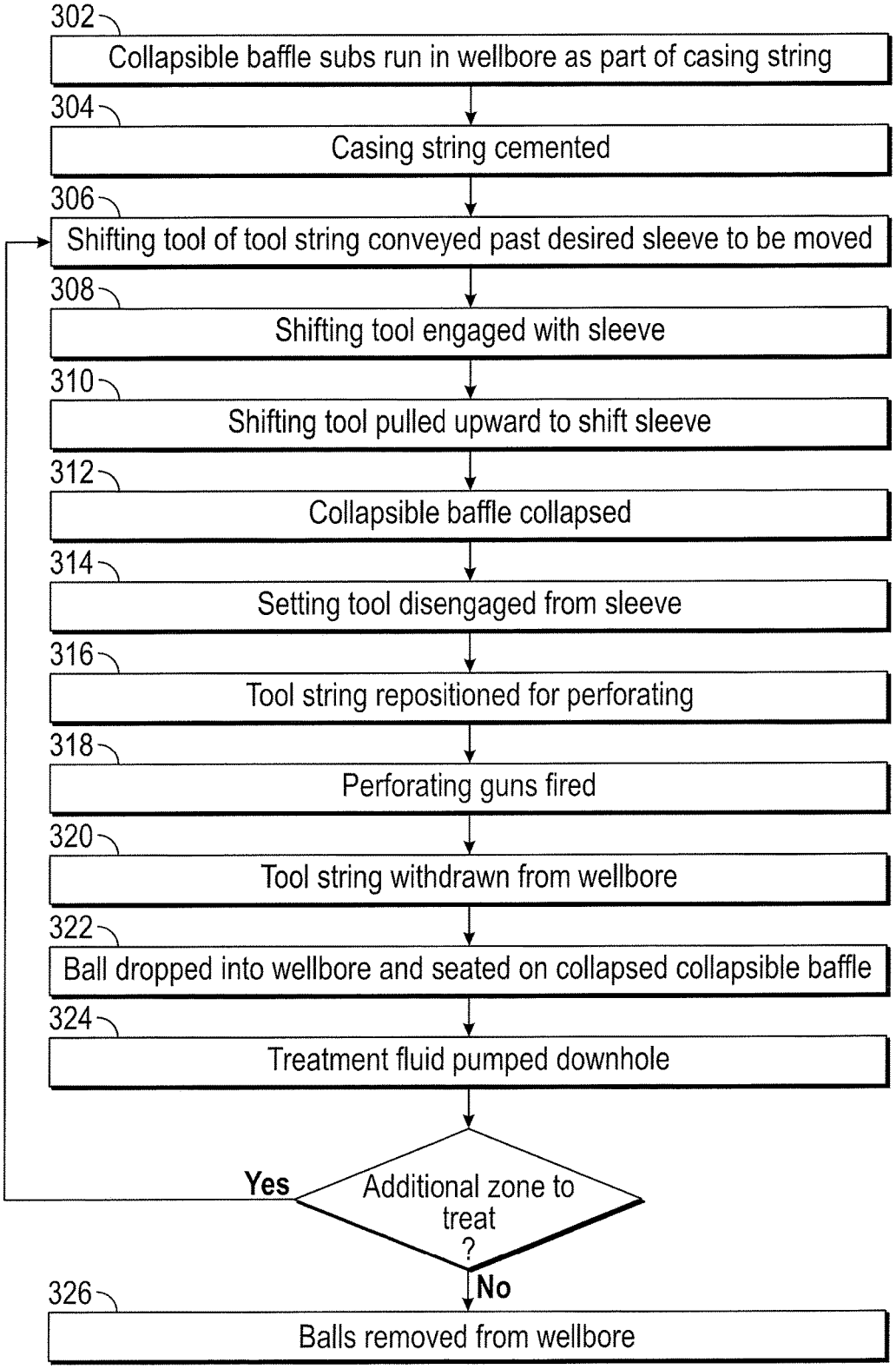
FIG. 3 is a flow chart depicting an example of use of a collapsible baffle sub to facilitate a fracturing treatment.

FIG. 3 is a flow chart illustrating one embodiment of a method for treating a wellbore using collapsible baffle subs, such as collapsible baffle sub 100 of FIGS. 1A and 1B. The steps described in the following example are intended to be illustrative only and should not be seen as limiting the scope of the claims.

At step 302, collapsible baffle subs are run into the wellbore as part of a casing string. Installation of the collapsible baffle subs within the casing string may be done as the casing string is run into the wellbore using techniques and equipment commonly used when running casing string. Once the casing string and the collapsible baffle subs incorporated therein are positioned within the wellbore, the casing string is cemented in place, as indicated at step 304.

At step 306, a shifting tool, which in this example is incorporated into a tool string that also includes a perforating gun, is conveyed via wire, e-line, coiled tubing, or a similar conveyance system through the inside of the casing string and past the collapsible baffle sub corresponding to a first production zone to be treated. During this process, fluid may also be pumped into the casing string to facilitate conveyance of the tool string.

For purposes of this example, the setting tool includes deployable keys, as previously discussed in this disclosure. After the setting tool is conveyed past the collapsible baffle sub, the deployable keys may be deployed. Then, at step 308, the shifting tool may be pulled uphole to engage a sleeve within the collapsible baffle sub. Once the shifting tool has engaged the sleeve, the next step 310 is to shift the sleeve within the collapsible baffle sub by further pulling the shifting tool uphole by the wire, e-line, coiled tubing or similar conveyance.

With the sleeve now shifted, a collapsible baffle within the collapsible baffle sub collapses at step 312. The setting tool may then be disengaged from the sleeve at step 314, and repositioned to align the perforating gun with the first production zone at step 316. The perforating guns may then be fired at step 318, perforating the adjacent casing string, cement, and formation. After firing the perforating guns, the tool string may be removed from the wellbore at step 320.

In embodiments in which the setting tool is not incorporated with a perforating gun into a single tool string, the setting tool may be removed from the wellbore after disengaging from the sleeve. After the setting tool is removed, a second tool including a perforating gun may be run into the wellbore to perforate the casing at the first production zone.

With the collapsible baffle collapsed within the collapsible baffle sub, the collapsible baffle is able to receive an untethered object, such as a ball. Accordingly, in step 322, a ball is dropped into the casing string and seats against the collapsible baffle, forming a seal between the collapsible baffle and the ball. As alternatives to dropping the ball, the ball may be shot or pumped into the casing string as well.

With the production zone now isolated, treatment fluid, such as fracturing fluid, may be pumped into the casing string to perform the desired stimulation treatment, as indicated at step 324. The treatment fluid is permitted to flow though the perforations and into the production zone, but is prevented from travelling within the casing string beyond the collapsible baffle and ball due to the seal between them above.

Once stimulation treatment for the production zone is complete, the above process generally consisting of actuating the collapsible baffle sub, perforating the casing, inserting a ball, and pumping treatment fluid, may be repeated for a second production zone and any other remaining production zones thereafter.

After all production zones have been stimulated, step 326 involves removal of any balls used to isolate each of the production zones. Removal of the balls permits formation fluids to flow through the casing string to the surface. The balls may be removed in various ways. For example, in one embodiment, a pump at or near the surface may pump fluid from the wellbore. Doing so reverses the pressure within the casing string, causing the balls to unseat from the collapsible baffles and to be drawn to the surface for removal. The balls may also be made of a dissolvable material and removed by circulating through the wellbore a fluid suitable for dissolving the balls. For example, the fluid may be an abrasive fluid that erodes the balls or may be a chemical selected to react with and decompose the particular material from which the balls were made. The balls may also be mechanically removed or destroyed by running a milling bit or similar tool through the casing string.

As previously mentioned, the method described above and depicted in FIG. 3 illustrates but one embodiment. Other embodiments may include variations on the above description. For example, in embodiments in which the casing string has multiple collapsible baffle subs, the sleeves of two or more of the collapsible baffle subs may be shifted in a single run of the setting tool. The setting tool may also include a perforating gun capable of perforating multiple production zones in a single run.

In embodiments where multiple production zones are prepared for treatment in a single run, the collapsible baffles of the collapsible baffle subs may vary in their inside diameters when collapsed. Varying inside diameters permits the use of different sizes of untethered objects to selectively isolate volumes of the casing string. For example, in a casing string having an uphole baffle and a downhole baffle, the uphole baffle may be configured to have a larger inside diameter when collapsed than the downhole baffle. This would permit a ball having a diameter measuring between the inside diameters of the uphole and downhole baffles to be inserted into the wellbore and sealed against the downhole baffle despite the uphole baffle being collapsed.

Although numerous characteristics and advantages of embodiments of the present invention have been set forth in the foregoing description and accompanying figures, this description is illustrative only. Changes to details regarding structure and arrangement that are not specifically included in this description may nevertheless be within the full extent indicated by the claims.

What is claimed is:

1. A method of treating a subterranean formation having a wellbore formed therein, comprising:

attaching at least one collapsible baffle sub to a section of casing of a casing string, the at least one collapsible baffle sub comprising:

a housing;

a sleeve disposed within the housing and movable between a first position and a second position; and a collapsible baffle, disposed within the housing, wherein in the first position, the sleeve retains the collapsible baffle and in the second position, the collapsible baffle is permitted to collapse within the housing;

wherein the collapsible baffle comprises a ring that includes a split, wherein the collapsible baffle has a first diameter when in an uncollapsed position and a second diameter when in a collapsed position, and wherein the second diameter is smaller than the first diameter;

installing the section of casing and the at least one collapsible baffle sub in the wellbore;

moving the sleeve from the first position to the second position;

collapsing the collapsible baffle within the housing; and perforating the casing string downhole to create one or more perforations, wherein the collapsible baffle is actuated and the one or more perforations are created in a single run, and wherein a fluid is permitted to flow through the one or more perforations and into a production zone and prevented from flowing within the casing string beyond the collapsible baffle.

2. The method of claim 1, further comprising:

inserting an untethered object into the wellbore; and creating a seal between the untethered object and the collapsible baffle when collapsed within the housing.

3. The method of claim 2, wherein the untethered object comprises a dissolvable material.

4. The method of claim 2, wherein the untethered object is a ball.

5. The method of claim 1, wherein the sleeve is moved from the first position to the second position using a shifting tool.

6. The method of claim 5, wherein the shifting tool is conveyed by one of a group consisting of a wireline, an e-line, and coiled tubing.

7. A system for treating a wellbore, comprising:

a casing string disposed within the wellbore, the casing string comprising at least one collapsible baffle sub, wherein the at least one collapsible baffle sub comprises a sleeve and a collapsible baffle;

wherein the sleeve is movable between a first position in which the sleeve retains the collapsible baffle and a second position in which the collapsible baffle is permitted to collapse within the collapsible baffle sub such that a fluid is permitted to flow through one or more perforations created downhole in the casing string and into a production zone and prevented from flowing within the casing string beyond the collapsible baffle due to a seal created by the collapsible baffle, wherein the collapsible baffle is actuated and the one or more perforations are created in a single run; and wherein the collapsible baffle comprises a ring that includes a split, wherein the collapsible baffle has a first diameter when in an uncollapsed position and a second diameter when in a collapsed position, and wherein the second diameter is smaller than the first diameter.

8. The system of claim 7, further comprising:

an untethered object disposed in the collapsible baffle and sealing against the collapsible baffle.

9. The system of claim 8, wherein the untethered object comprises a dissolvable material.

10. The system of claim 8, wherein the untethered object is a ball.

11. The system of claim 7 wherein a deployable key is deployable in response to an electrical signal to engage or disengage the sleeve.

12. An apparatus for treating a subterranean formation, comprising:

a housing, wherein the housing is suitable for connection to a section of casing of a casing string;

a sleeve disposed within the housing and movable between a first position and a second position; and a collapsible baffle disposed within the housing, wherein in the first position, the sleeve retains the collapsible baffle and in the second position, the collapsible baffle is permitted to collapse within the housing such that a fluid is permitted to flow through one or more perforations created downhole in the casing string and into a production zone and prevented from flowing within the casing string beyond the collapsible baffle due to a seal created by the collapsible baffle, wherein the collapsible baffle is actuated and the one or more perforations are created in a single run, and wherein the collapsible baffle comprises a split-ring that includes a split, wherein the collapsible baffle has a first diameter when in an uncollapsed position and a second diameter when in a collapsed position, and wherein the second diameter is smaller than the first diameter.

13. The apparatus of claim 12, wherein when collapsed, the collapsible baffle is suitable for receiving an untethered object.

14. The apparatus of claim 12, wherein the collapsible baffle comprises an elastomeric coating.

15. The apparatus of claim 12, wherein at least one of the collapsible baffle and the sleeve comprise a dissolvable material.

16. The apparatus of claim 12, further comprising:

an atmospheric sleeve disposed within the housing such that movement of the atmospheric sleeve causes the collapsible baffle to collapse, wherein when the sleeve is in the second position, fluid is permitted to impinge upon the atmospheric sleeve to cause movement of the atmospheric sleeve.

* * * * *